US006749330B2

(12) United States Patent
Allen

(10) Patent No.: US 6,749,330 B2
(45) Date of Patent: Jun. 15, 2004

(54) CEMENT MIXING SYSTEM FOR OIL WELL CEMENTING

(76) Inventor: Thomas E. Allen, 9722 S. Oswego Ave., Tulsa, OK (US) 74137

( * ) Notice: Subject to any disclaimer, the term of this patent is extended or adjusted under 35 U.S.C. 154(b) by 243 days.

(21) Appl. No.: 09/999,339

(22) Filed: Nov. 1, 2001

(65) Prior Publication Data

US 2003/0081493 A1 May 1, 2003

(51) Int. Cl.[7] ..... B01F 5/04; B01F 15/02

(52) U.S. Cl. ..... 366/136; 366/160.2; 366/173.2; 366/178.2; 366/178.3

(58) Field of Search ..... 366/3, 10, 34, 366/134, 136, 137, 160.1, 160.2, 162.1, 163.2, 165.1, 165.2, 167.1, 173.1, 173.2, 178.1–178.3

(56) References Cited

U.S. PATENT DOCUMENTS

| | | | | | |
|---|---|---|---|---|---|
| 3,201,093 | A | | 8/1965 | Smith | |
| 3,298,669 | A | * | 1/1967 | Zingg | 366/178.1 |
| 3,424,386 | A | * | 1/1969 | Maasberg et al. | 366/178.2 |
| 3,542,342 | A | | 11/1970 | Barron | |
| 3,741,533 | A | | 6/1973 | Winn, Jr. | |
| 4,007,921 | A | | 2/1977 | Zingg | |
| 4,125,331 | A | | 11/1978 | Chisholm | |
| 4,538,921 | A | * | 9/1985 | Kennedy | 366/178.3 |
| 4,643,582 | A | | 2/1987 | Ricciardi | |
| 4,688,945 | A | * | 8/1987 | Brazelton et al. | 366/178.1 |
| 4,778,280 | A | | 10/1988 | Brazelton | |
| 4,838,701 | A | | 6/1989 | Smith et al. | |
| 5,039,227 | A | | 8/1991 | Leung et al. | |
| 5,046,855 | A | | 9/1991 | Allen et al. | |
| 5,289,877 | A | | 3/1994 | Naegele et al. | |
| 5,355,951 | A | | 10/1994 | Allen et al. | |
| 5,426,137 | A | * | 6/1995 | Allen | 366/178.3 |
| 5,571,281 | A | | 11/1996 | Allen | |
| 5,857,773 | A | * | 1/1999 | Tammelin | 366/178.1 |

* cited by examiner

*Primary Examiner*—Charles E. Cooley
(74) *Attorney, Agent, or Firm*—Molly D. McKay

(57) ABSTRACT

A powder mixing system and mixer for mixing cement used in cementing oil wells or other similar dry powder mixtures. The mixer is provided with a central recirculation jet and with annularly located alternating recirculation and mix water jets that discharge into the mixing chamber of the mixer in an overlapping fashion to effectively wet dry cement introduced into the mixing chamber. The mix water jets are formed from a set of slots provided both in a rotatable element and from another set of slots provided in a stationary portion so that when the rotatable element rotates, the size of mix water jets is adjusted. Two inlet elbows attach to the inlet of the central recirculation jet to cause the flow from the jet to rotate in a diverging pattern.

22 Claims, 10 Drawing Sheets

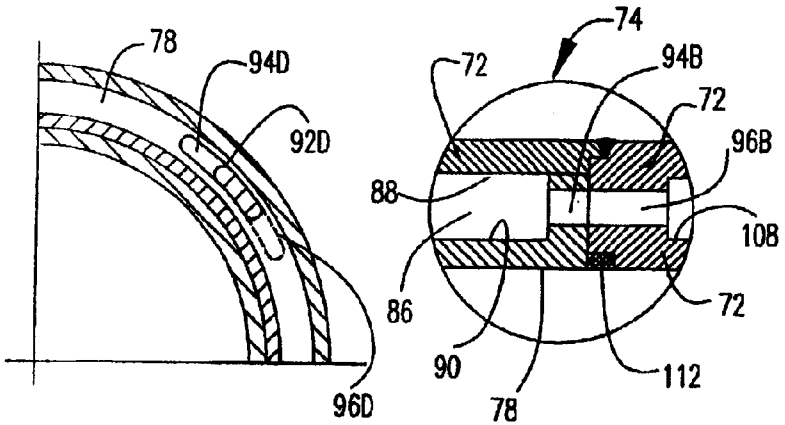
FIG 7
FIG 6
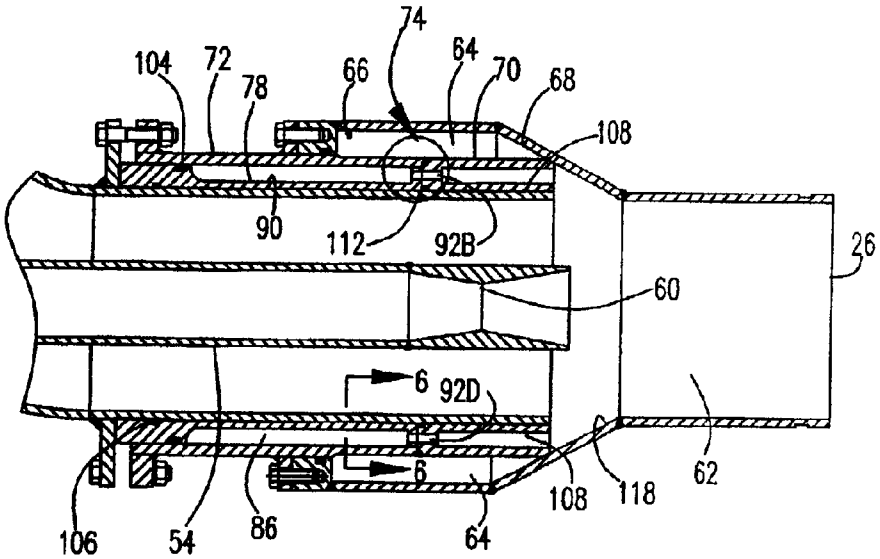
FIG 5

CEMENT MIXING SYSTEM FOR OIL WELL CEMENTING

CROSS-REFERENCE TO RELATED APPLICATIONS

Applicant is one if the co-inventors of U.S. Pat. No. 5,046,855 that issued on Sep. 10, 1991 for Mixing Apparatus; one of the co-inventors of U.S. Pat. No. 5,355,951 that issued on Oct. 18, 1994 for Method of Evaluating Oil or Gas Well Fluid Process; and the sole inventor of U.S. Pat. No. 5,571,281 that issue on Nov. 5, 1996 for Automatic Cement Mixing and Density Simulator and Control System and Equipment for Oil Well Cementing.

BACKGROUND OF THE INVENTION

1. Field of the Invention

The present invention relates to a high efficiency, high energy slurry mixer used primarily to mix oil field cement in a recirculating system for cementing the casing in oil and gas wells. Specifically, the present invention employs continuous recirculation via a central recirculation line and via annular recirculation jets that are spaced alternately with annular adjustable mix water jets.

2. Description of the Related Art

Utilization of cement within oil wells, particularly in the cementing of casing therein, has been under development since the early 1900's. Two of the purposes of placing cement into the annular space between the casing and the formation are to support the casing within the well, and to seal off undesirable formation fluids.

Casing is typically secured in the well bore by the cement which is mixed at the surface, then pumped down the open center of the casing string and thence back up the annular space which exists between the outer diameter of the casing and the inner diameter of the oil well bore. A displacement fluid, such as drilling mud, is pumped behind the cement to push the cement to the desired location. In many oil and gas well applications it is often necessary to provide cement mixers which will rapidly prepare large quantities of material to be pumped into the well by a batch or continuous process until a sufficient predetermined quantity has been applied.

In either case, the process usually begins with the material being pre-prepared by dry blending and then adding water at the well site. Batch mixing is one form of system to obtain a satisfactory slurry, but batch mixing requires an initial outlay of a large amount of equipment, people, and space. In offshore operations, space and weight capacity are expensive. Batch mixers use valuable space and add to rig weight. Typically, large tanks with rotary paddle type mixers, although being able to adequately perform the mixing operations, have not been efficient in term of space, numbers of people required or equipment costs where large volumes of mixing must be done at the well site.

The quality of the cement slurry placement process involves the completeness of the mixing process and the pumping rate which can affect the bond between the casing and the well bore. The completeness of the mixing process depends on the efficiency of wetting all the dry bulk particles. The pumping rate affects the bond by having an important effect on mud displacement efficiency. There are many other factors that affect the quality of the cementing process.

Many types of cement mixers have been known in the prior art. For example, jet-type mixers and vortex mixers such as those disclosed in U.S. Pat. Nos. 3,201,093 and 3,741,533 have been used with considerable success but have not necessarily been successful in continuously mixing cement slurries. Such jet or eductor type mixers worked reasonably well when slurry designs were simple. With the more enhanced slurry designs of today, the jet mixer cannot adequately mix these slurries. Early type mixers generally had centrally located water jets, while later models added a recirculation flow in combination with the central water jets.

Continuous recirculation mixers were developed to overcome some of the deficiencies of the jet type and batch mixers. These systems mix dry cement and water in an inlet mixer, the output going to a tank for agitation with excess slurry flowing over a weir to an averaging tank, which may be agitated, thence pumped into the well. Typically, a portion of the mixed slurry was recirculated from the mixing tank and directed back into a modified jet mixer. Thus, newly delivered dry bulk cement was wetted both by water and recirculated cement. This provided additional mixing energy that enabled satisfactory mixing. These type mixers were first introduced during the early 1970's. Since that time, cement slurry design has evolved into the use of more complex slurries that earlier continuous mixing systems are unable to mix satisfactorily. Thixotropic slurries with very low "free water" requirements have evolved for the deep, high temperature, high pressure gas wells. It seems as though the industry is constantly testing the ability of mixers by developing even more difficult to mix slurries.

Although prior inventions have taught use of centrally located recirculation jets, or alternately, annularly located recirculation jets, none of the prior art teaches or suggests the desirability of providing both centrally located and annularly located recirculation jets. The present invention incorporates this arrangement and adds mix water jets located between the discrete annularly located recirculation jets so that flows from the annular recirculation jet and the water jets overlap each other. With this arrangement, recirculation rate in the present mixer is independent of slurry design or mixing rate, but is only dependent upon recirculating pump capacity and mixer design.

One of applicant's previous inventions, as taught in U.S. Pat. No. 5,046,855, provided a combination of annular water jets and recirculation jets with no centrally located jets. Another of applicant's previous inventions, as taught in U.S. Pat. No. 5,571,281, included annular recirculation jets and a centrally located water jet. The short coming of the U.S. Pat. No. 5,571,281 mixer was when mixing slurries that had a low water requirement, i.e. small number of gallons of water per sack of cement, or when the mixer was used in a batch mode, there is insufficient energy to effectively wet all the incoming dry bulk cement. The present invention addresses this problem by having both centrally located and annularly located recirculation jets which operate all the time and provide good mixing regardless of slurry design or operation in continuous or batch modes.

Prior art mixers, including both the U.S. Pat. No. 5,046,855 mixer and the U.S. Pat. No. 5,571,281 mixer, utilize discrete annular recirculation jets, i.e. the former having two and the latter having four. The use of discrete jets is practical, but allows the potential bulk cement to by pass the jets, and thus discharge without becoming wet. The present invention addresses this problem by having the mix water jets located between the discrete recirculation jets. These mix water jets overlap the discrete recirculation jets, thus providing 100% coverage of the flow path of the dry bulk cement.

Also, the U.S. Pat. No. 5,046,855 mixer also suffered from discrete mix water jets. That design included six sets of three jets each, for a total of eighteen jets. These jets opened consecutively as increasing water rate was required. Coverage was good when all jets were open, but when only the first set of jets was operational due to low mix rate or low water requirement or both, coverage was poor and mixing quality suffered.

The U.S. Pat. No. 5,571,281 invention provided a continuous circumferential and diverging flow pattern for mix water which worked well when relatively high water rates were required but provided little mixing energy when low water requirements existed or when batch mixing. The present invention provides good coverage and mixing energy regardless of mix water requirement or while batch mixing.

The prior U.S. Pat. No. 5,571,281 mixer provides "baffled" annular space through which recirculated flow passes. This design is unnecessarily restrictive to the recirculation flow and has a low coefficient of discharge. The flow path of the present invention for annular recirculated flow is more streamlined and thus has a higher coefficient of discharge. With a higher coefficient of discharge, this means that pressure head is converted to velocity more efficiently and therefore provides the same mixing energy with less input horsepower.

One object of the present invention is to improve the mixing capabilities as compared to prior art mixers. The present invention will provide more effective and efficient mixing over a wide range of conditions, including both batch mixing and continuous mixing modes.

A second object of the present invention is to have effective mixing while only recirculating water and/or slurry from a mix tank and not adding additional water. Present technology performance during this mode of operation is significantly degraded. This operation is typical while starting the recirculating process or while batch mixing.

A third object of the present invention is to provide both a centrally located recirculation jet and a plurality of equally spaced annular recirculation jets. Bulk cement enters the mixer and encounters high energy jets from the center and from annular jets. These jets have trajectory angles which intercept the dry bulk, breaking it apart and effectively wetting the incoming dry bulk.

A fourth object of the present invention is to provide a plurality of annular and adjustable water jets located at alternate positions from the annular recirculation jets. These jets, in combination with the recirculation annular jets, provide improved mixing and more effective wetting of the bulk cement.

A fifth object of the present invention is to provide a mixing system that provides more predictable slurry properties due to improved and effective mixing.

A sixth object of the present invention is to provide a mixer which provides high mixing energy while consuming less energy.

A seventh object of the present invention is to allow the use of more than one recirculation pump source, further optimizing the use of mixing energy sources.

These and other objects will become more apparent upon further review of referenced drawings, detailed description, and claims submitted herewith.

SUMMARY OF THE INVENTION

The present invention is a cement mixing system and mixer for mixing cement that will be used in cementing oil wells. A recirculation pump recirculates the contents of a cement mixing tank to the mixer via annular recirculation flow inlets provided on the mixer, and also via a central recirculation inlet provided on the mixer.

The mixer is provided with the bulk cement inlet, the central recirculation inlet and associated central recirculation line, the mix water inlet, the annular recirculation flow inlets, a mix water adjustment input means, and the slurry outlet.

The centrally located central recirculation line discharges through a nozzle into a mixing chamber provided within the mixer.

The annular recirculation flow inlets connect to a recirculation manifold chamber which is defined by the inside diameter of an outer housing of the mixer and the outside diameter of the fixed part of the water metering means. The water metering means consists of the fixed part that cooperates with a movable part. The movable part is comprised of a rotatable water metering valve element and its attached mix water adjustment input means. The recirculation manifold chamber is connected to parallel multiple recirculation outlets where each recirculation outlet is defined by two surfaces within the mixer. The recirculation outlets discharge into the mixing chamber.

The mix water inlet is connected to a mix water manifold chamber which is defined by the I.D. of the fixed part of the water metering means and the O.D. of the rotatable water metering valve element. The mix water manifold chamber is connected to parallel multiple and elongated jet outlets. Each elongated jet outlet is formed by a matching set of elongated jet openings, with one of the elongated jet openings of each set provided in the rotatable water metering valve element and with a cooperating and associated elongated jet opening provided in the fixed part of the water metering means. Each matching set of elongated jet outlets are located in such a way that if the rotatable water metering valve element is rotated, the size of orifice of each of the elongated jet outlets is changed. Mix water flows out of the mix water manifold chamber via the adjustable jet outlets which discharge into the mixing chamber. The jet outlets which discharge mix water into the mix chamber are located so that they alternate with and are evenly spaced relative to the annular flow recirculation outlets. The evenly spaced and alternating jet outlets deliver mix water annularly to the mixing chamber and recirculation outlets also deliver recirculation flow annularly to the mixing chamber. The discharge nozzle of the central recirculation line delivers recirculation flow centrally within the mixing chamber.

The elongated metering slots of the rotatable water metering valve element are equally spaced. The element is provided with threaded holes as means to attach a mix water adjustment input means to the rotatable water metering valve element via threaded fasteners to rotate the rotatable water metering valve element in order to adjust the flow of mix water passing through the elongated jet outlets. Grooves are provided in the rotatable water metering valve element to accommodate pressure seals to contain water pressure within the mix water manifold chamber.

Elongated metering slots in the fixed part of the water metering means are equally spaced and alternately located between the recirculation outlets. The water discharge chamber is connected to the metering slots. Each of the recirculation outlets changes shape and decreases in cross sectional area as it approaches the mixing chamber, thereby increasing fluid velocity as the recirculated slurry approaches the mixing chamber. A groove is provided for a seal to prevent mix water from entering the I.D. of the chamber The centrally located central recirculation line conveys recirculation flow to a discharge nozzle provided in the line. Two inlet elbows that attach to the central recirculation line are arranged at 90 degree angles to each other so as to cause the flow of recirculation within the line to rotate. Therefore when discharged from the nozzle, the recirculation fluid continues to rotate. The rotational flow tends to diverge as it discharges from the nozzle in a pattern that enhances mixing.

BRIEF DESCRIPTION OF THE DRAWINGS

FIG. 5 is a cross sectional view of the slurry mixer of FIG. 4, taken along line 5—5 with the junction of a movable part and a stationary part of the adjustable water metering valve shown highlighted.

FIG. 6 is a cross sectional view taken along line 6—6 of FIG. 3.

FIG. 7 is an enlarged view of the portion of FIG. 5 that is highlighted by the circle.

DETAILED DESCRIPTION OF THE PREFERRED EMBODIMENT THE INVENTION

Figure 1:
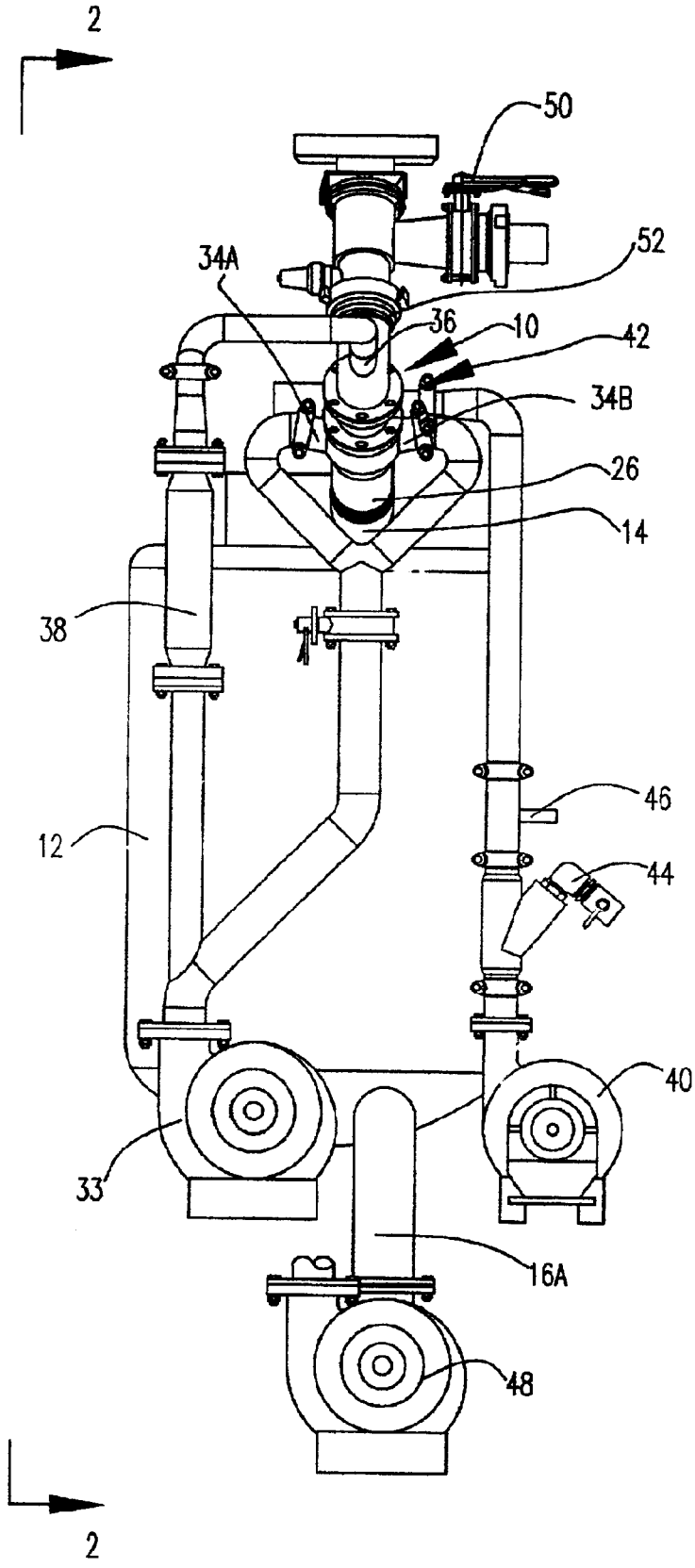
FIG. 1 is an end view of a slurry mixer that is constructed in accordance with a preferred embodiment of the present invention. The slurry mixer is shown in use in a mixing system.
Figure 2:
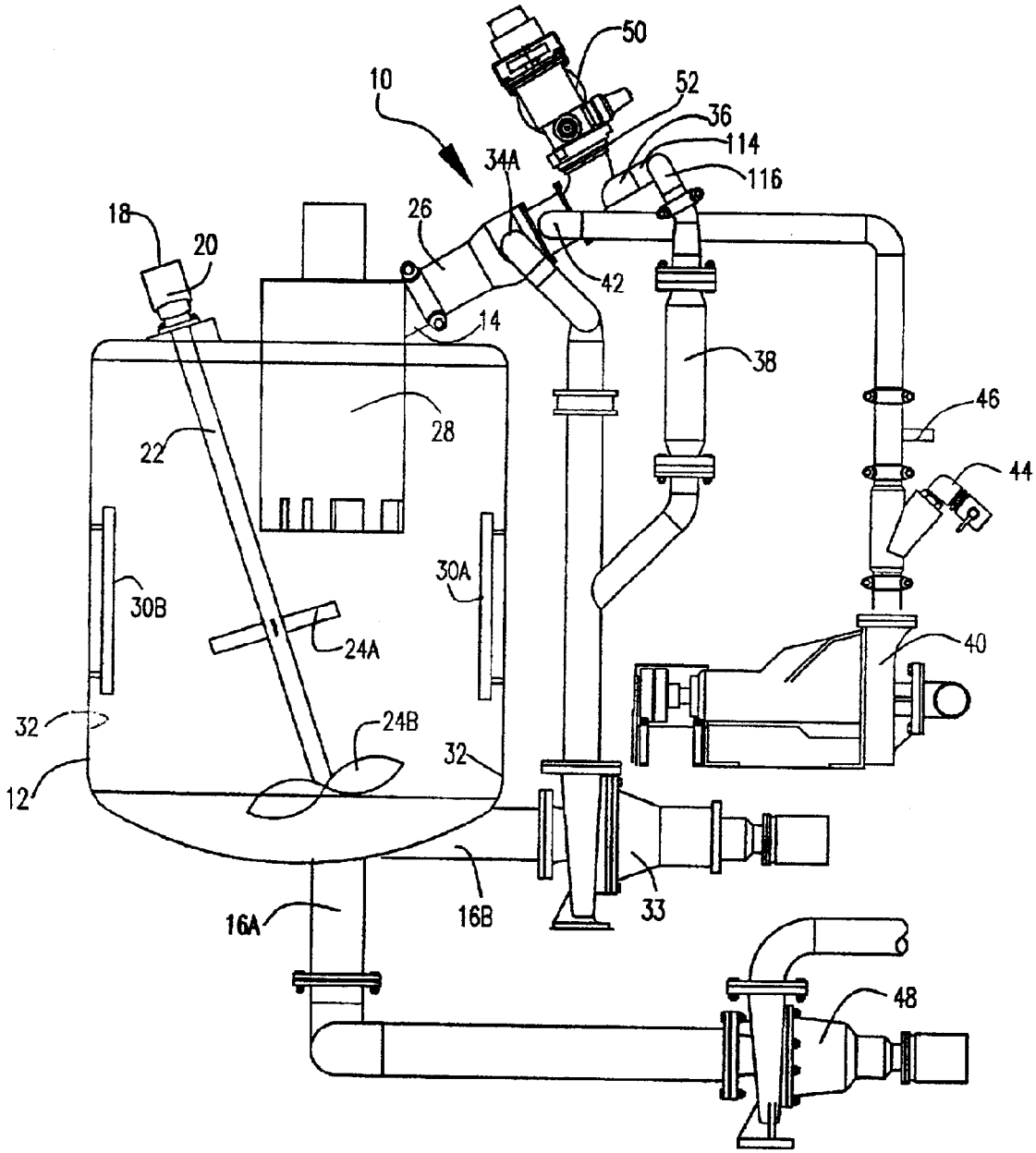
FIG. 2 is a side view of the mixing system of FIG. 1 taken along line 2—2.

Referring now to the drawings, the present invention is a cement mixing system and mixer 10 for mixing cement that will be used in cementing oil wells. The overall typical system within which the mixer 10 is likely to be used is illustrated in FIGS. 1 and 2. The mixer discharges into a mixing tank 12, which is similar to other mixing tanks found in literature and in practice. The tank 12 is designed for continuous mixing with a steady throughput rate with a tank inlet 14 for incoming fluids and one or more tank outlets 16A and 16B for discharging mixed fluids. The tank 12 is equipped with an agitator 18 for further mixing and homogenizing the contents of the tank 12. The agitator 18 is comprised of a motor 20, shaft 22, and various agitator blades 24A, 24B, etc.

An outlet 26 of the mixer 10 is attached to the tank inlet 14, and the tank inlet 14 is attached to a passive separator device 28 which centrifugally separates air from the liquid mixture. Fixed plates 30A, 30B, etc are attached to the inside wall 32 of the tank to prevent the contents of the tank 10 from rotating excessively and promote mixing within the tank 10.

A recirculation pump 33 is attached to one of the tank outlets 16B. The recirculation pump 33 recirculates the contents of the mixing tank 12 to the mixer 10 via annular recirculation flow inlets 34A and 34B provided on the mixer 10, and also to the mixer 10 via a central recirculation inlet provided on the mixer 10 by way of a densitometer 38.

A mix water pump 40 that is connected to a supply of mix water and pumps that mix water under high pressure, i.e. 150–175 pounds per square inch, to the mixer 10 via a mix water inlet 42 provided on the mixer 10. The discharge of the mix water pump 40 has a strainer 44 for filtering out debris and a flow meter 46 for measuring the rate and total of water addition.

A transfer pump 48 that is attached to one of the tank outlets 16A transfers mixed slurry to high pressure pumps (not illustrated) for pumping the slurry down the well that is to be cemented.

There is a cement bulk metering valve 50 that is attached to a bulk cement inlet 52 provided on the mixer 10 as a means of regulating the amount of bulk dry cement that enters the mixer 10 via the bulk cement inlet 52.

The mixer 10 is the subject of the present invention. A preferred embodiment of the invention is shown in the attached drawings and will be more fully described hereafter.

Figure 3:
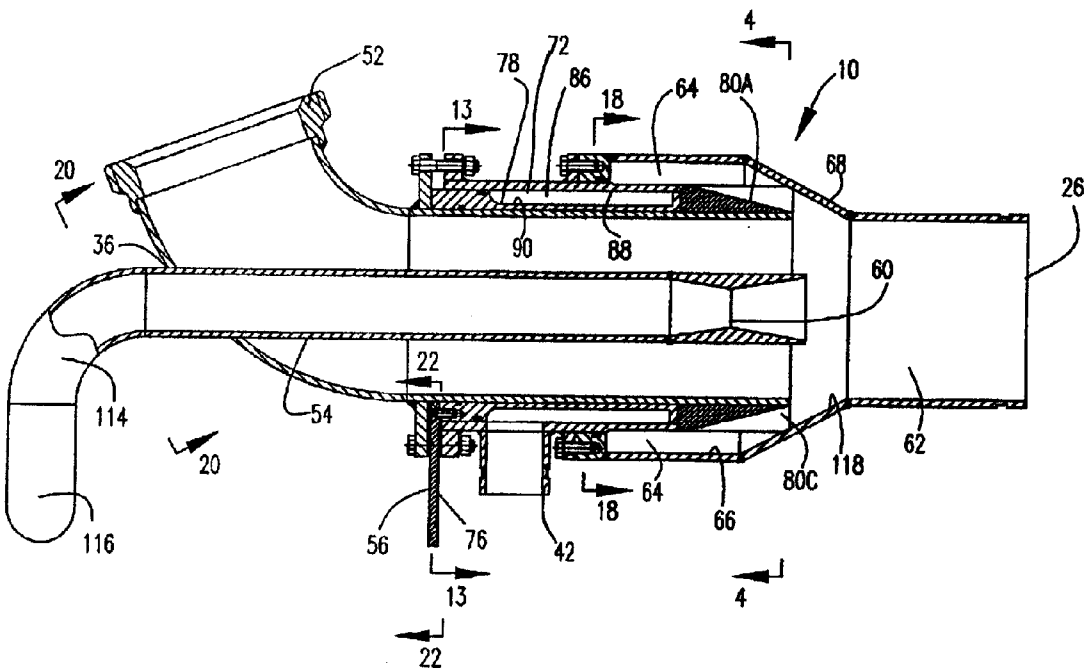
FIG. 3 is a cross sectional view of the slurry mixer of FIG. 2 shown at an orientation that is 180 degrees from the view shown in FIG. 2.

The mixer 10 is shown in cross sectional view in FIG. 3. Also referring to FIGS. 20, 21, 22 and 23, the mixer 10 is provided with the bulk cement inlet 52, the central recirculation inlet 36 and associated central recirculation line 54, the mix water inlet 42, the annular recirculation flow inlets 34A and 34B, a mix water adjustment input means 56, and the slurry outlet 26.

Figure 4:
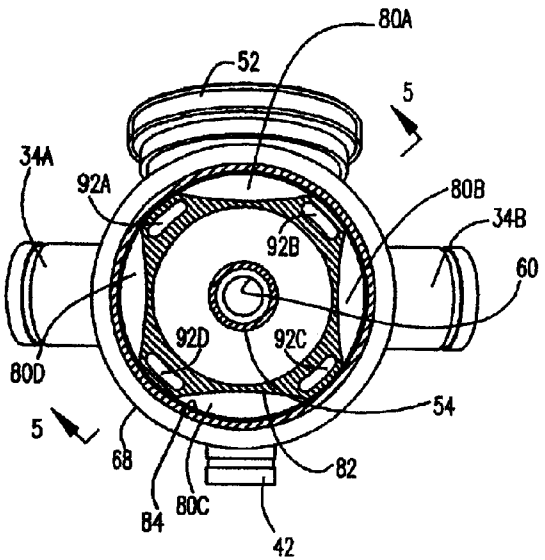
FIG. 4 is a cross sectional view of the slurry mixer of FIG. 3 taken along line 4—4.
Figures 11, 12, 13, 14, 15:
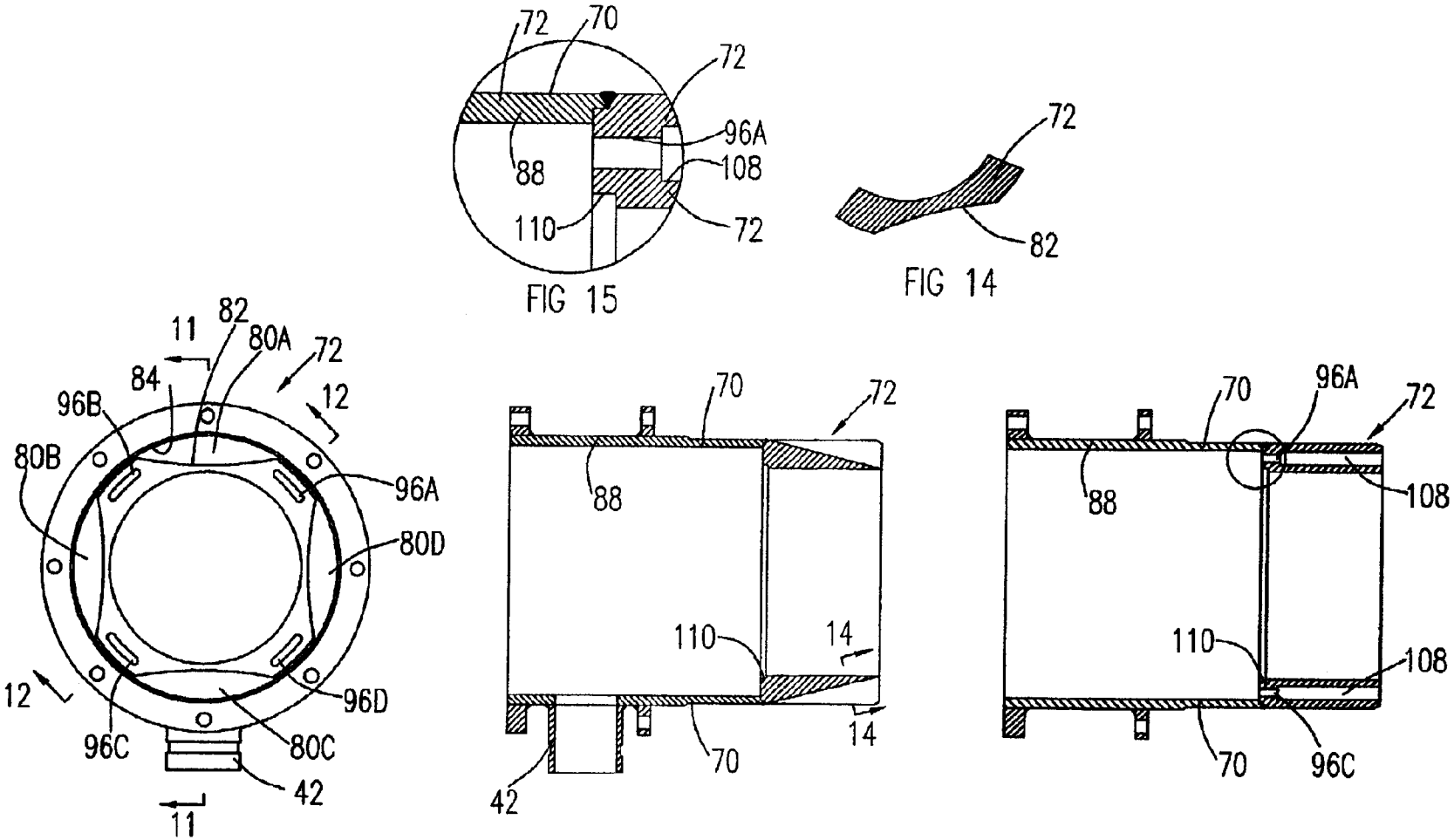
FIG. 11 is a cross sectional view of a stationary element of the water metering valve taken along line 11—11 of FIG. 13.
FIG. 12 is a cross sectional view of the stationary element of the water metering valve taken along line 12—12 of FIG. 13.
FIG. 13 is an end view of the stationary element of the water metering valve taken along line 13—13 of FIG. 3.
FIG. 14 is a cross sectional view taken along line 14—14 of FIG. 11.
FIG. 15 is an enlarged view of the portion of FIG. 12 that is highlighted by the circle.

The centrally located central recirculation line 54 discharges through a nozzle 60 into a mixing chamber 62 provided within the mixer 10. The annular recirculation flow inlets 34A and 34B connect to a recirculation manifold chamber 64 that is shown in FIG. 5. The recirculation manifold chamber 64 is defined by the inside diameter 66 or I.D. of an outer housing 68 of the mixer 10 and the outside diameter 70 or O.D. of the fixed part 72 of the water metering means 74. As will be described in more detail hereafter, the water metering means 74, illustrated in FIG. 7, consists of the fixed part 72 which cooperates with a movable part 76. The movable part 76 is comprised of a rotatable water metering valve element 78 and its attached mix water adjustment input means 56, as illustrated in FIG. 3. Referring now to FIGS. 3, and 4, the recirculation manifold chamber 64 is connected to parallel multiple recirculation outlets 80A, 80B, 80C, and 80D which are defined by surfaces 82 and 84. In FIG. 4 surfaces 82 are located on the inside wall of and partially define the recirculation outlets 80A, 80B, etc. Also in FIG. 4, surfaces 84 are located on the outside wall of and partially define the recirculation outlets 80A, 80B, etc. Surfaces 82 are located on the external surface of the fixed part 72, as shown in FIG. 14. Surfaces 84 are located on the internal surface of outside housing 68. The recirculation outlets 80A, 80B, 80C, and 80D discharge into the mixing chamber 62.

Figure 9:
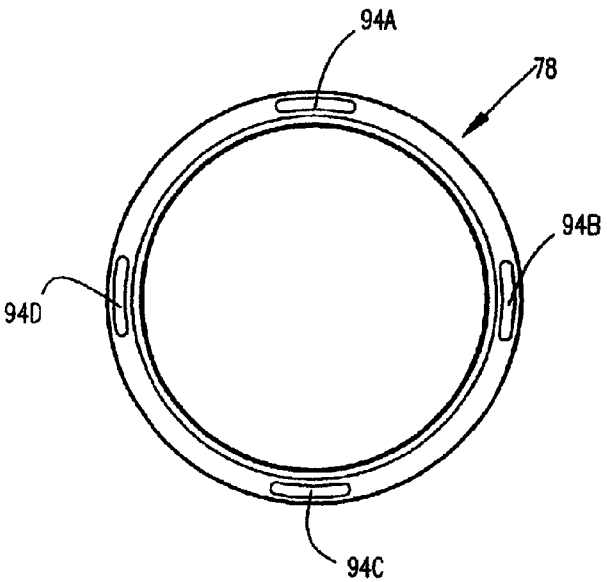
FIG. 9 is an end view of the rotatable water metering valve element taken along line 9—9 of FIG. 8.

As illustrated in FIGS. 3, 5, and 7, the mix water inlet 42 is connected to a mix water manifold chamber 86 which is defined by the I.D. 88 of the fixed part 72 of the water metering means 74 and the O.D. 90 of the rotatable water metering valve element 78. As illustrated in FIGS. 4 and 13, the mix water manifold chamber 86 is connected to parallel multiple and elongated jet outlets 92A, 92B, 92C, and 92D. Referring now to FIGS. 4, 9, and 13, each elongated jet outlet 92A, 92B, 92C, and 92D is formed by a matching set of elongated jet openings 94A and 96A, 94B and 96B, 94C and 96C, and 94D and 96D respectively, with one of the elongated jet openings 94A, 94B, 94C, and 94D provided in the rotatable water metering valve element 78 and with a cooperating and associated elongated jet opening 96A, 96B, 96C, and 96D provided in the fixed part 72 of the water metering means 74. Each matching set, i.e. set 94A and 96A, set 94B and 96B, set 94C and 96C, and set 94D and 96D, of elongated jet outlets are located in such a way that if the rotatable water metering valve element 78 is rotated, the size of orifice of each of the elongated jet outlets 92A, 92B, 92C, and 92D is changed. Mix water flows out of the mix water manifold chamber 86 via the adjustable jet outlets 92A, 92B, 92C, and 92D which discharge into the mixing chamber 62, as shown in FIG. 5. The jet outlets 92A, 92B, 92C, and 92D which discharge mix water into the mix chamber 62 are located so that they alternate with and are evenly spaced relative to the annular flow recirculation outlets 80A, 80B, 80C, and 80D. FIG. 4 shows an end view of the evenly spaced and alternating jet outlets 92A, 92B, 92C, and 92D that deliver mix water annularly to the mixing chamber 62 and recirculation outlets 80A, 80B, 80C, and 80D that also deliver recirculation flow annularly to the mixing chamber 62. FIG. 4 also shows the discharge nozzle 60 of the central recirculation line 54 that delivers recirculation flow centrally within the mixing chamber 62.

Figure 8:
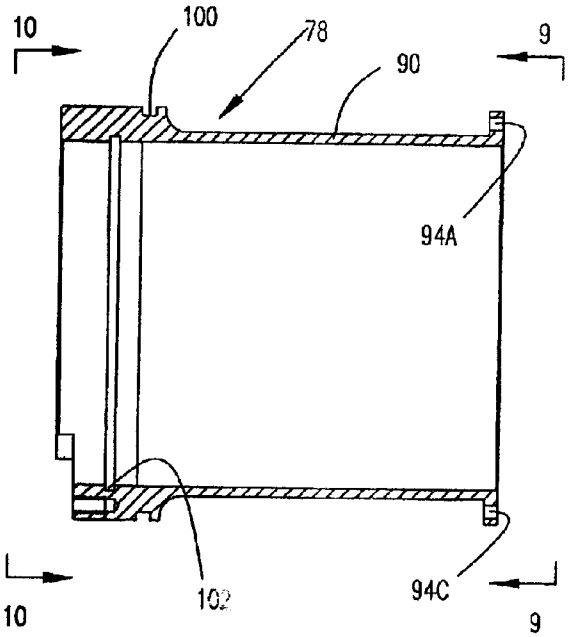
FIG. 8 is a side view of a rotatable element of the water metering valve of the slurry mixer of FIG. 5.
Figure 10:
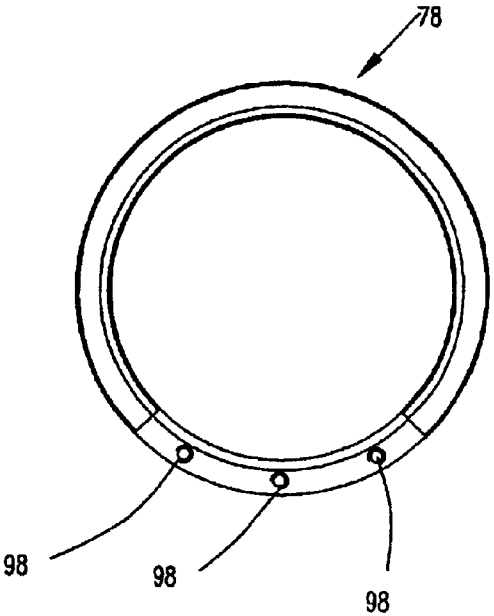
FIG. 10 is an end view of the rotatable water metering valve element taken along line 10—10 of FIG. 8.

FIGS. 8, 9, and 10 provide a better view of the rotatable water metering valve element 78. The elongated metering slots 94A, 94B, 94C, and 94D are equally spaced. Also referring to FIGS. 22 and 23, the element 78 is provided with threaded holes 98 as means to attach a mix water adjustment input means 56, i.e. a lever or handle, to the rotatable water metering valve element 78 via threaded fasteners 99 to rotate the rotatable water metering valve element 78 in order to adjust the flow of mix water passing through the elongated jet outlets 92A, 92B, 92C, and 92D. Grooves 100 and 102, illustrated in FIG. 8, are provided in the rotatable water metering valve element 78 to accommodate pressure seals 104 and 106, illustrated in FIG. 5, to contain water pressure within the mix water manifold chamber 86.

FIGS. 11, 12, 13, 14, and 15 show detailed views of the fixed part 72 of the water metering means 72 that also forms part of the annular recirculation manifold chamber 64. Elongated metering slots 96A, 96B, 96C, and 96D are equally spaced and alternately located between the recirculation outlets 80A, 80B, 80C, and 80D. A separate water discharge chamber 108 is connected to each of the metering slots 96A, 96B, 96C, and 96D, and all of the water discharge chambers 108 discharge mix water into the mixing chamber 62. FIGS. 11, 13, and 14 in particular are designed to show that each of the recirculation outlets 80A, 80B, 80C, and 80D changes shape and decreases in cross sectional area as it approaches the mixing chamber 62, thereby increasing fluid velocity. The recirculation manifold chamber 64 changes gradually from a common manifold to distinct discharge nozzles, jets or outlets 80A, 80B, 80C, and 80D. A groove 110 is provided for a seal 112 to prevent mix water from leaking into the mixing chamber 62.

Figure 17:
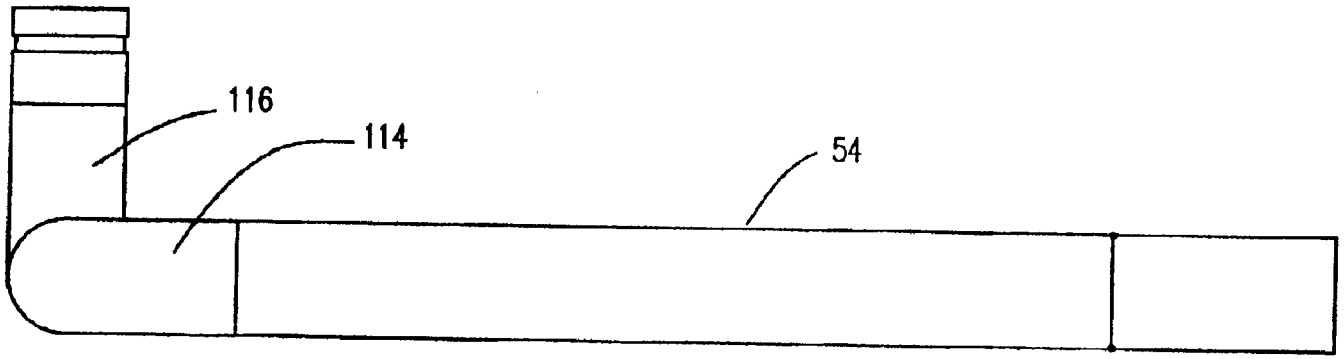
FIG. 17 is a top view of the central recirculation fluid line of FIG. 16, showing the double elbow provided in the line.
Figure 16:
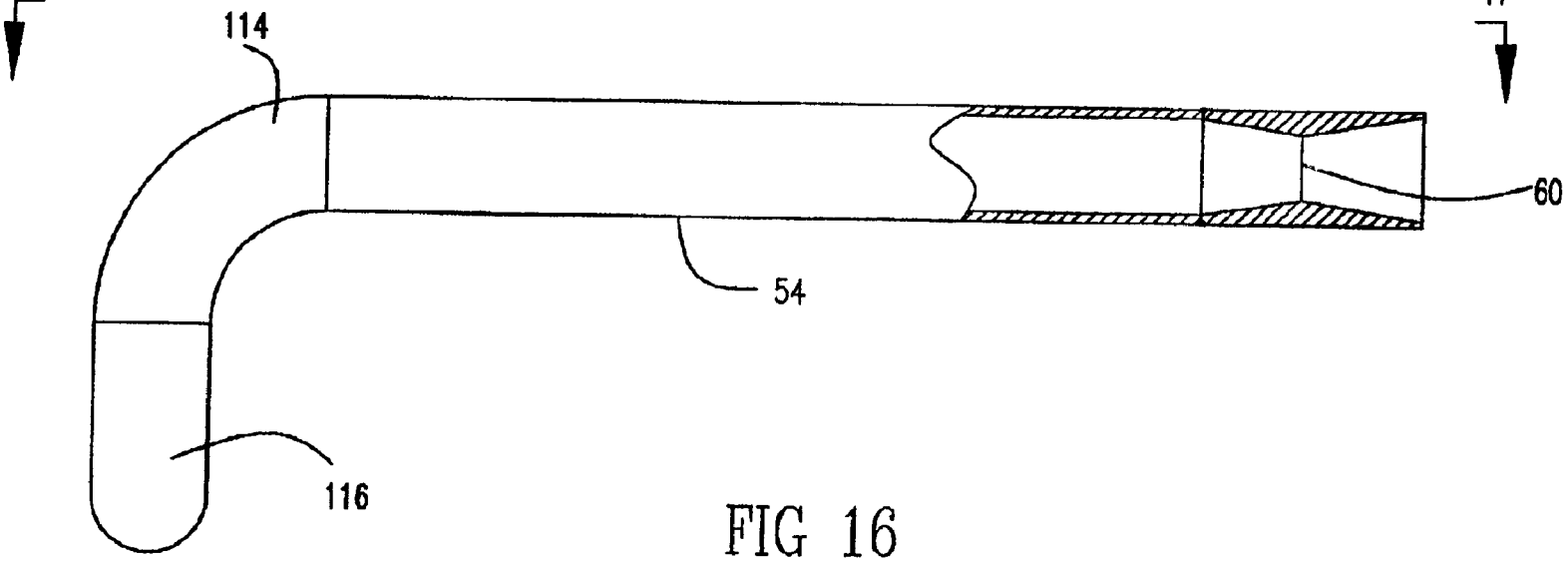
FIG. 16 is a partially cut away side view of the central recirculation fluid line of FIG. 3.

FIGS. 16 and 17 show in detail the centrally located central recirculation line 54 and nozzle 60. This line 54 conveys recirculation flow to the discharge nozzle 60. A combination of inlet elbows 114 and 116 are arranged at 90 degree angles to each other so as to cause the flow of recirculation within the line 54 to rotate and therefore when discharged from the nozzle, the recirculation fluid continues to rotate. The rotational flow tends to diverge as it discharges from the nozzle 60 in a pattern that enhances mixing.

Operation of the Invention

The continuous mixing process begins with batch mixing the first tank slurry. A volume of water is discharged from the mixer 10 to the mixing tank 12. The volume of water to be discharged is governed by the amount required for the recirculation pump 33 to effectively operate and pump water or slurry from the mixing tank 12 to the mixer 10. The recirculated flow enters the mixer 10 via inlets 36, 34A and 34B. The centrally located nozzle 60 discharges recirculated fluid at a high velocity into the mixing chamber 62. Recirculated flow also enters the mixing chamber 62 at a high velocity via the multiple recirculation outlets 80A, 80B, 80C, and 80D from the annular recirculation manifold chamber 64. The outwardly angled discharge of recirculation from the nozzle 60 of the central recirculation line 54 and the inwardly angled annular flow from the recirculation outlets 80A, 80B, 80C, and 80D are such that they intersect one another, creating significant turbulence and thus mixing energy.

Figure 19:
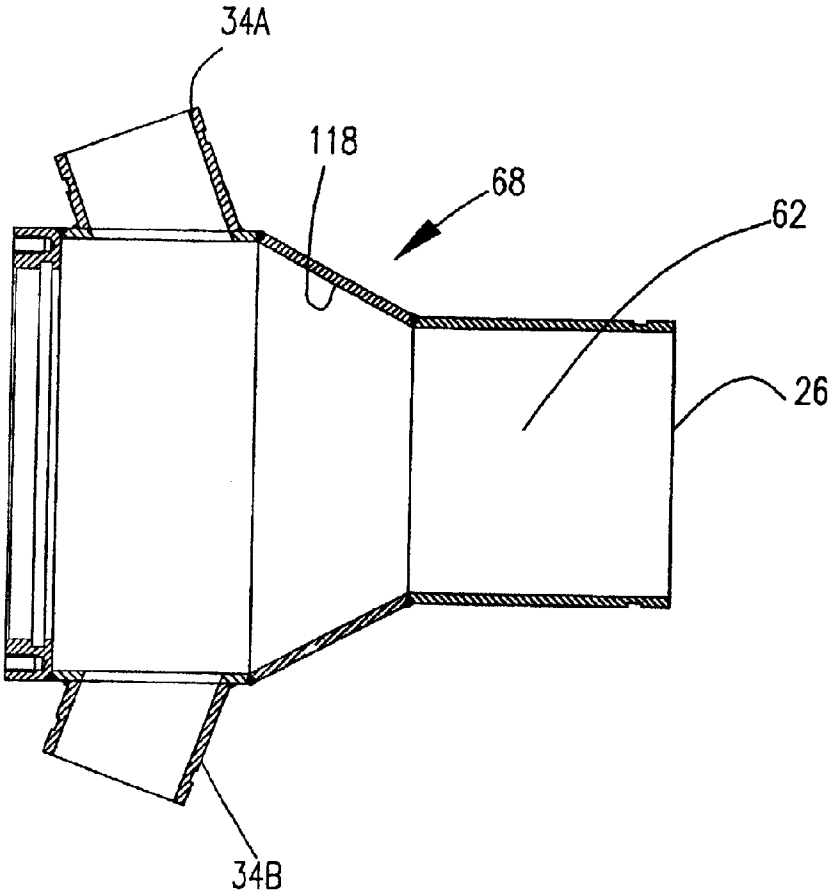
FIG. 19 is a cross sectional view of the mixing chamber portion of the slurry mixer taken along line 19—19 of FIG. 18.
Figure 18:
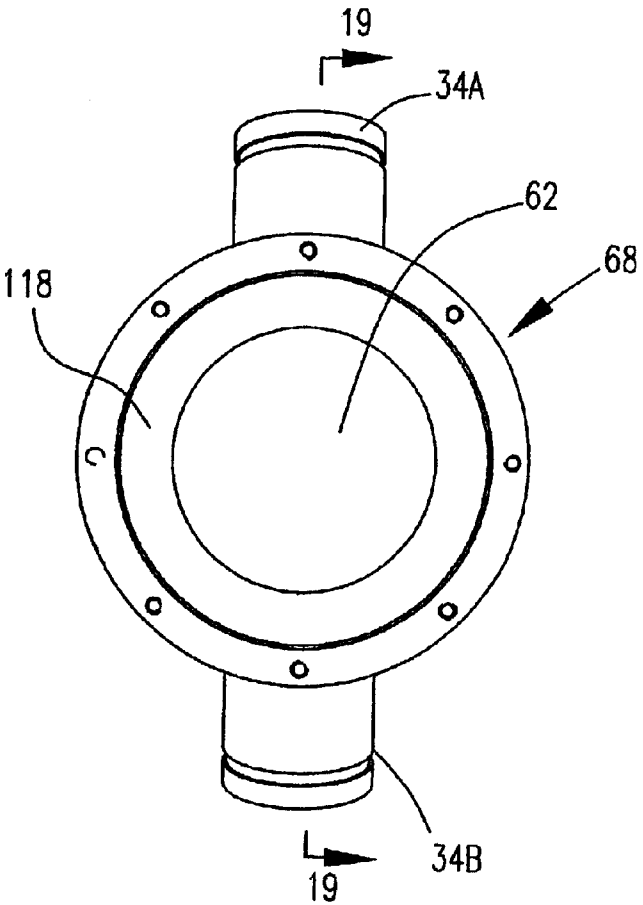
FIG. 18 is an end view of a mixing chamber portion of the slurry mixer taken along line 18—18 of FIG. 3.
Figure 21:
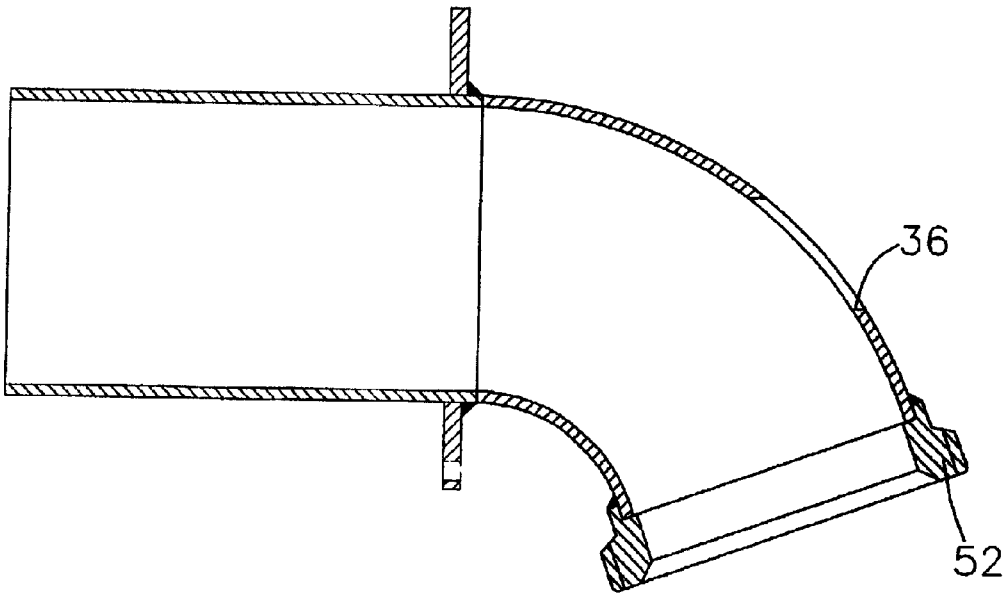
FIG. 21 is a cross sectional view of the cement inlet portion of the slurry mixer taken along line 21—21 of FIG. 20.
Figure 20:
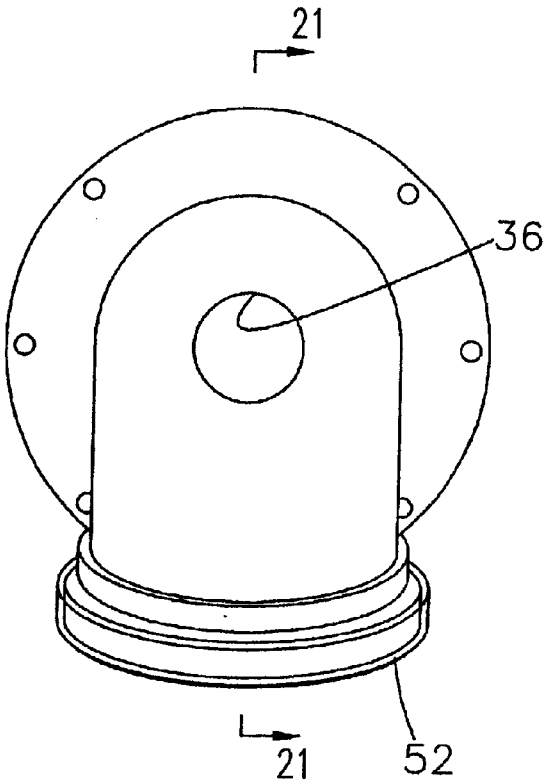
FIG. 20 is a end view of the cement inlet portion of the slurry mixer taken along line 20—20 of FIG. 3.
Figure 23:
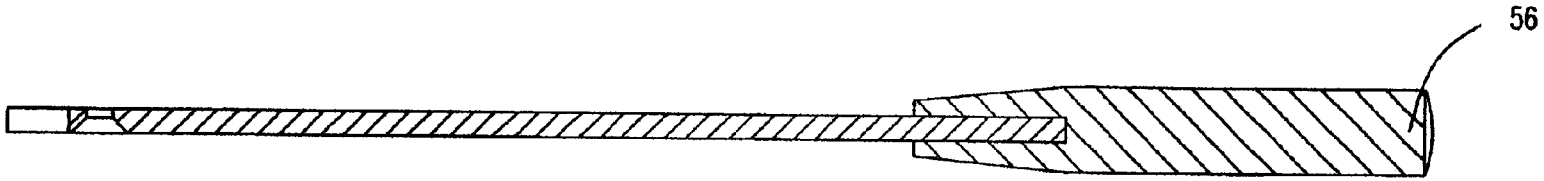
FIG. 23 is a cross sectional view of the handle of FIG. 3, taken along line 23—23.
Figure 22:
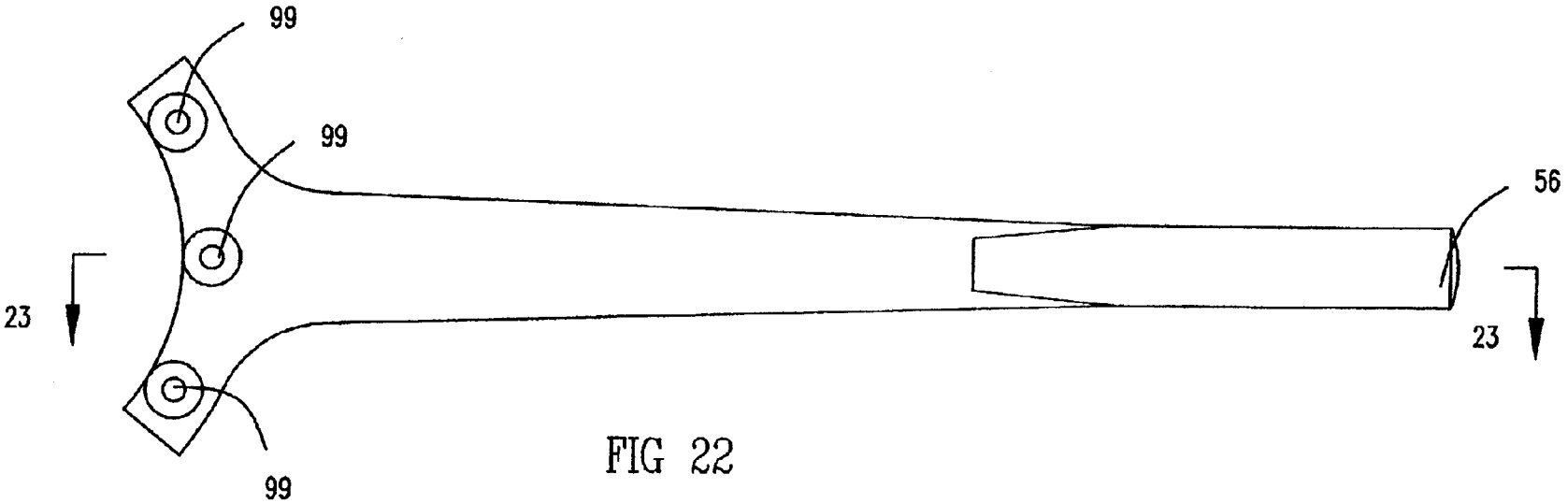
FIG. 22 is an enlarged view of the mix water adjustment handle taken along line 22—22 of FIG. 3.

The mix water discharges in an axial direction from the mix water manifold chamber 86 via elongated jet outlets 92A, 92B, 92C, and 92D. This flow impacts an inwardly angled interior surface portion 118 of the housing 68 and is deflected into the mixing chamber 62. The inwardly angled interior surface portion 118 is best show in FIGS. 18 and 19. This flow of mix water from the jet outlets 92A, 92B, 92C, and 92D adds to the mixing energy already provided by the recirculated central flow emanating from the nozzle 60 of the central recirculation line 54 and from the annular flow emanating from the recirculation outlets 80A, 80B, 80C, and 80D. During the initial stages of the mixing process, which resembles a batch process, only recirculated flow is used for mixing. After the mixing tank 12 is full, the process changes from a batch type process to a continuous process whereas inlet flows of water and cement and outlet flows of slurry are approximately equal. Equal rates of inlet flows and outlet flows will maintain a constant fluid level in the mixing tank 12. The rate of mix water flowing into the mixer 10 is controlled by the mix water adjustment input means, i.e. the lever 56, which is connected to the rotatable water metering valve element 78. The metering valve element 78 with its elongated jet openings or slots 94A, 94B, 94C, and 94D rotates relative to fixed slots 96A, 96B, 96C, and 96D that are in provided in the fixed part 72 of the water metering means or valve 74 and are of a similar size and shape to the jet openings 94A, 94B, 94C, and 94D. When the two sets of metering slots, i.e. set 94A, 94B, 94C, and 94D and set 96A, 96B, 96C, and 96D, become less aligned, they form jet outlets 92A, 92B, 92C, and 92D that become increasingly restrictive to water flow and therefore reduce the mix water rate. Further rotation of the rotatable water metering valve element 78 will ultimately reach a point at which the water flow is completely shut off. The relationship of the position of the mix water adjustment input means or lever 56 for rotating the rotatable water metering valve element 78 and water flow are proportional to each other and nearly linear to each other.

Discharged mixed slurry exits the mixing chamber 62 via the outlet 26 of the mixer 10 and enters the passive separator device 28 which separates air that was used to transport dry bulk cement into the mixer 10 via the bulk cement inlet 52 from the slurry. This is accomplished in the passive separator device 28 by causing the slurry to follow a circular path which causes centrifugal forces to separate the low density air from the slurry. The slurry discharges into the mixing tank 12 below the fluid level. The agitator 18 further mixes and homogenizes the contents of the mixing tank 12. The mixed slurry is picked up by the recirculation pump 33 and is discharged back into the mixer 10 via the central recirculation line 54 and annular recirculation flow inlets 34A and 34B for mixing with newly delivered bulk cement. The transfer pump 48 also sucks slurry from the mix tank 12 and discharges the same to the high pressure pumps (not illustrated) for pumping down the well that is to be cemented.

Although the invention has been described for use in mixing cement for oil or gas wells, the invention is not so limited and can be used to mix a variety of bulk powders into a solution. Also, the usage of this invention is not limited to the oil and gas industry, but could be used in other industries where dry bulk powders must be mixed into a solution, such as for example the food preparation industry.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A powder mixer for mixing a dry powder with liquid comprising:

a powder mixer having a centrally located central recirculation line terminating in a mixing chamber of the powder mixer for continuously recirculating wetted powder mixture centrally into the mixing chamber, said powder mixer being provided annularly with recirculation outlets that discharge into the mixing chamber for continuously recirculating wetted powder mixture annularly into said mixing chamber, and said powder mixer being provided annularly with adjustable water jet outlets in alternating arrangement with said recirculation outlets that discharge into the mixing chamber for regulating the amount of mix water introduced annularly into said mixing chamber of the powder mixer.

2. A powder mixer according to claim 1 further comprising:

a bulk powder inlet provided in said mixer for introducing bulk dry powder into the mixing chamber of the mixer between the central recirculation line and the annular recirculation outlets.

3. A powder mixer according to claim 2 further comprising:

a rotatable water metering valve element provided within said mixer and rotatable by means of an attached mix water adjustment input means, said rotatable water metering valve element provided with jet openings therethrough, and a fixed part provided in said mixer, said fixed part provided with jet openings therethrough so that the jet openings provided in the rotatable water metering valve element and the jet openings provided in the fixed part cooperate to form the adjustable water jets outlets.

4. A powder mixer according to claim 3 wherein the annular recirculation outlets converge inwardly within the mixing chamber and wherein a nozzle at the exit of the central recirculation line diverges outwardly within the mixing chamber causing flow from the outlets and nozzle to intersect and thoroughly wet and mix with any dry bulk powder that is introduced into the mixing chamber.

5. A powder mixer according to claim 4 further comprising:

inlet elbows attached to the inlet of the central recirculation line to cause the flow within the central recirculation line to rotate which promotes a diverging pattern when the slurry exits the central recirculation line.

6. A powder mixer according to claim 4 further comprising:

an inwardly angled interior surface portion provided in the mixing chamber adjacent the adjustable water jet outlets so that flow of mix water from said adjustable water jet outlets inpinges on said inwardly angled interior surface portion and deflects the mix water inwardly within the mixing chamber to mix with and wet any dry bulk powder introduced into the mixing chamber.

7. A powder mixing method for mixing powder for use in high volume mixing applications comprising:

introducing recirculating wetted powder mixture via a nozzle provided on a central recirculation line centrally into a mixing chamber of a powder mixer, introducing recirculating wetted powder mixture via recirculation outlets provided annularly in said mixture annularly into said mixing chamber, introducing a regulated amount of mix water via adjustable water jet outlets located in said mixer in alternating arrangement with said recirculation outlets into said mixing chamber, and introducing dry bulk powder via a bulk powder inlet provided in said mixer into said mixing chamber between the central recirculation line and the recirculation outlets so that the mix water and recirculating wetted powder mixture thoroughly wet and mix with the dry bulk.

8. A powder mixing method according to claim 7 further comprising:

regulating the amount of mix water introduced into said mixing chamber by rotating a rotatable water metering valve element provided within said mixer by means of an attached mix water adjustment input means so that jet openings provided in said rotatable water metering valve element cooperate with jet openings provided in a fixed part of said mixer to adjust the opening size of the ajustable water jets outlets.

9. A powder mixing method according to claim 7 wherein flow of wetted powder mixture from the annular recirculation outlets is introduced into the mixing chamber so that it converges inwardly within the mixing chamber and wherein flow of wetted powder mixture from the central recirculation line is introduced into the mixing chamber so that it diverges outwardly within the mixing chamber to thoroughly wet and mix with any dry bulk powder that is introduced into the mixing chamber.

10. A powder mixing method according to claim 9 wherein flow of mix water from the adjustable water jet outlets is introduced into the mixing chamber so that it impinges on an inwardly angled interior surface portion provided in the mixing chamber and is deflected inwardly within the mixing chamber to mix with and wet any dry bulk powder introduced into the mixing chamber.

11. A powder mixer for mixing a dry powder with liquid comprising:

a powder mixer being provided annularly with recirculation outlets that discharge into a mixing chamber of the powder mixer for continuously recirculating wetted powder mixture annularly into said mixing chamber, and said powder mixer being provided annularly with adjustable water jet outlets in alternating arrangement with said recirculation outlets that discharge into the mixing chamber for regulating the amount of mix water introduced annularly into said mixing chamber of the powder mixer.

12. A powder mixer according to claim 11 further comprising:

a bulk powder inlet provided in said mixer for introducing bulk dry powder into the mixing chamber of the mixer centrally within the annular recirculation outlets.

13. A powder mixer according to claim 12 further comprising:

a rotatable water metering valve element provided within said mixer and rotatable by means of an attached mix water adjustment input means, said rotatable water metering valve element provided with jet openings therethrough, and a fixed part provided in said mixer, said fixed part provided with jet openings therethrough so that the jet openings provided in the rotatable water metering valve element and the jet openings provided in the fixed part cooperate to form the adjustable water jets outlets.

14. A powder mixer according to claim 13 wherein the annular recirculation outlets converge inwardly within the mixing chamber causing flow from the outlets to thoroughly wet and mix with any dry bulk powder that is introduced into the mixing chamber.

15. A powder mixer according to claim 14 further comprising:

an inwardly angled interior surface portion provided in the mixing chamber adjacent the adjustable water jet outlets so that flow of mix water from the adjustable water jet outlets inpinges on said inwardly angled interior surface portion and deflects the mix water inwardly within the mixing chamber to mix with and wet any dry bulk powder introduced into the mixing chamber.

16. A powder mixer for mixing a dry powder with liquid comprising:

a powder mixer having a centrally located central recirculation line terminating in a mixing chamber of the powder mixer for continuously recirculating wetted powder mixture centrally into the mixing chamber, said powder mixer being provided annularly with recirculation outlets that discharge into the mixing chamber for continuously recirculating wetted powder mixture annularly into said mixing chamber, a bulk powder inlet provided in said mixture for introducing bulk dry powder into the mixing chamber of the mixer between the central recirculation line and the annular recirculation outlets, the annular recirculation outlets converge inwardly within the mixing chamber and a nozzle at the exit of the central recirculation line diverges outwardly within the mixing chamber causing flow from the outlets and nozzle to intersect and thoroughly wet and mix with any dry bulk powder that is introduced into the mixing chamber, inlet elbows attached to the inlet of the central recirculation line to cause the flow within the central recirculation line to rotate which promotes a diverging pattern when the slurry exits the central recirculation line.

17. A powder mixing method for mixing powder for use in high volume mixing applications comprising:

introducing recirculating wetted powder via recirculation outlets provided annularly in said mixer annularly into a mixing chamber of a powder mixer, introducing a regulated amount of mix water via adjustable water jet outlets located in said mixer in alternating arrangement with said recirculation outlets into said mixing chamber, and introducing dry bulk powder via a bulk powder inlet provided in said mixer into said mixing chamber centrally within the recirculation outlets so that the mix water and recirculating wetted powder mixture thoroughly wet and mix with the dry bulk powder.

18. A powder mixing method according to claim 17 further comprising:

regulating the amount of mix water introduced into said mixing chamber by rotating a rotatable water metering valve element provided within said mixer by means of an attached mix water adjustment input means so that jet openings provided in said rotatable water metering valve element cooperate with jet openings provided in a fixed part of said mixer to adjust the opening size of the adjustable water jets outlets.

19. A powder mixing method according to claim 17 wherein flow of wetted powder mixture from the annular recirculation outlets is introduced into the mixing chamber so that it converges inwardly within the mixing chamber to thoroughly wet and mix with any dry bulk powder that is introduced into the mixing chamber.

20. A powder mixing method according to claim 19 wherein flow of mix water from the adjustable water jet outlets is introduced into the mixing chamber so that it impinges on an inwardly angled interior surface portion provided in the mixing chamber and is deflected inwardly within the mixing chamber to mix with and wet any dry bulk powder introduced into the mixing chamber.

21. A powder mixing method for mixing powder for use in high volume mixing applications comprising:

introducing recirculating wetted powder mixture via a nozzle provided on a central recirculation line centrally into a mixing chamber of a powder mixer, introducing recirculating wetted powder mixture via recirculation outlets provided annularly in said mixture annularly into said mixing chamber, and introducing dry bulk powder via a bulk powder inlet provided in said mixer into said mixing chamber between the central recirculation line and the recirculation outlets so that the recirculating wetted powder mixture thoroughly wets and mixes with the dry bulk powder.

22. A powder mixing method according to claim 21 wherein flow of wetted powder mixture from the annular recirculation outlets is introduced into the mixing chamber so that it converges inwardly within the mixing chamber and wherein flow of wetted powder mixture from the central recirculation line is introduced into the mixing chamber so that it diverges outwardly within the mixing chamber to thoroughly wet and mix with any dry bulk powder that is introduced into the mixing chamber.

* * * * *